US009861142B1

(12) United States Patent
Rebecchi

(10) Patent No.: US 9,861,142 B1
(45) Date of Patent: Jan. 9, 2018

(54) VISOR WITH FANS TO DEFLECT VAPORS FOR EYE PROTECTION WHILE COOKING

(71) Applicant: Saverio Rebecchi, Jamestown, RI (US)

(72) Inventor: Saverio Rebecchi, Jamestown, RI (US)

( * ) Notice: Subject to any disclaimer, the term of this patent is extended or adjusted under 35 U.S.C. 154(b) by 0 days.

(21) Appl. No.: 15/648,603

(22) Filed: Jul. 13, 2017

(51) Int. Cl.

| | |
|---|---|
| ***A41D 13/002*** | (2006.01) |
| ***A41D 20/00*** | (2006.01) |
| ***F04D 25/16*** | (2006.01) |
| ***F04D 25/06*** | (2006.01) |
| ***F04D 29/40*** | (2006.01) |

(52) U.S. Cl.
CPC ..... *A41D 13/0025* (2013.01); *A41D 20/00* (2013.01); *F04D 25/0673* (2013.01); *F04D 25/166* (2013.01); *F04D 29/403* (2013.01)

(58) Field of Classification Search
CPC ..... A41D 13/0025; A41D 20/00; F04D 25/0673; F04D 25/166; A42C 5/04; A42B 3/286
See application file for complete search history.

(56) References Cited

U.S. PATENT DOCUMENTS 3,649,964 A * 3/1972 Schoelz ..... A61F 9/068 128/205.25
3,735,423 A * 5/1973 Droz ..... A42C 5/04 2/171.3
3,813,696 A * 6/1974 Yeager ..... A42B 3/286 2/171.3
3,881,478 A * 5/1975 Rosendahl ..... A42B 3/0406 128/200.28
4,680,815 A * 7/1987 Hirsch ..... A42C 5/04 2/171.3
5,425,620 A * 6/1995 Stroud ..... A42B 1/008 2/171.3
5,561,862 A * 10/1996 Flores, Sr. ..... A42B 3/286 2/171.3
6,032,291 A * 3/2000 Asenguah ..... A42B 1/008 2/171.3
6,843,964 B2 * 1/2005 Yeh ..... A42B 1/008 2/171.2
7,036,502 B2 * 5/2006 Manne ..... A62B 18/003 128/200.27
7,114,194 B2 * 10/2006 English ..... A42B 3/286 2/171.3
7,331,064 B1 * 2/2008 Quintal ..... A42B 1/008 2/171.3
8,480,365 B2 * 7/2013 Ochoa ..... F04D 25/0673 416/146 R
9,038,199 B2 * 5/2015 Becker ..... A61F 9/068 2/8.6
9,271,872 B2 * 3/2016 Becker ..... A61F 9/068
9,510,632 B2 * 12/2016 Perusse ..... A42B 3/286
9,631,804 B1 * 4/2017 Glenn ..... F21V 33/00
(Continued)

*Primary Examiner* — Alissa L Hoey

(57) ABSTRACT

A head worn visor having an array of battery operated fans in a chamber that includes contiguous air supply ducts that draw clean air from behind the user that is discharged through the visor fan array outlets in a downward force in front of the eyes to deflect irritating vapors that cause tearing from preparing food. The visor chamber houses the wiring and electrical connections to the fans and the dry cell battery compartment. The device operation is controlled by an on/off switch that activates the electrical circuitry.

1 Claim, 10 Drawing Sheets

(56) References Cited

U.S. PATENT DOCUMENTS

| | | | | |
|---|---|---|---|---|
| 2005/0061316 | A1* | 3/2005 | Manne | A62B 18/003<br>128/200.27 |
| 2009/0055987 | A1* | 3/2009 | Becker | A61F 9/068<br>2/8.6 |
| 2009/0126076 | A1* | 5/2009 | Ochoa | A42B 1/008<br>2/171.3 |
| 2009/0255025 | A1* | 10/2009 | Ochoa | A42B 3/286<br>2/7 |
| 2010/0000007 | A1* | 1/2010 | Wood | A42B 1/008<br>2/171.3 |
| 2014/0143934 | A1* | 5/2014 | Grzybowski | A42B 3/286<br>2/171.3 |
| 2014/0150163 | A1* | 6/2014 | Hatton | A42B 1/008<br>2/171.3 |
| 2014/0359917 | A1* | 12/2014 | Benson | A42B 3/286<br>2/171.3 |

* cited by examiner

VISOR WITH FANS TO DEFLECT VAPORS FOR EYE PROTECTION WHILE COOKING

TECHNICAL FIELD

The present invention relates to a visor worn by the user that produces a protective volume of air to deflect vapors that normally would irritate their eyes during the cutting, slicing, dicing and mashing of certain raw vegetables and the smoke generated by cooking on outdoor grills.

BACKGROUND OF THE INVENTION

It is a well know problem that challenges food preparers of all levels of skill that certain vegetables release vapors that irritate the eyes when they are being prepared for consumption. The most notable of those are onions.

In addition to the discomfort from gases that irritate the lachrymal glands making the eyes tear, the preparer is often in a situation of potential physical harm when they are using a knife or other sharp tools and need to see clearly what is being cut through their tears.

Although there are a number of suggested techniques to eliminate or reduce the ferocity of the vapors . . . like short term placement in the freezer, cutting under water or near hot running water steam, there is no standard promise of them working.

More recently the use of air sealed goggles is being offered as a solution but they are not unique to the wearer and fail when the user's face does not fit the standard form allowing vapors to eventually reach the eyes. The use of goggles is not usually chosen by those who wear prescription glasses and there is an obvious safety need to see properly while using sharp utensils and other such devices.

Those who have newer counter/cook top level exhaust fans are having some success in preventing the problem by drawing the vapors away from the cutting area on a horizontal plane.

That success leads to the conclusion that the solution is to prevent the vapors from reaching the eyes, which is very difficult during the normal food preparation activities, especially because the simple act of breathing draws the vapors being released by the food upward toward the face to the nostrils just below the eyes.

With the increased popularity of outdoor cooking on grills the problem of eye irritation from the smoke created by food juices and flavor coatings coming in contact with the heat source has heightened. The cook needs to be on guard to quickly step away a safe distance which takes a good amount of concentration and experience to avoid eye damage from the vapors.

There are various devices designed to protect the face during industrial, medical and military activities that could be used, but they are not very affordable or comfortable to wear, nor practical for the typical home cooking environment.

Other devices use battery operated fans to cool the head of a person wearing a hat and some clip on the visor to blow a curtain of air over the face for cooling as well. The problem with those systems is that they use air from the surrounding area which is usually in the front space of the wearer that becomes populated with eye irritating vapors created during the above mentioned activities. The food preparer usually tilts their head downward to concentrate on what they are doing which accelerates the front and hat top attached fans ability to draw contaminated vapors and blow them into the eyes that increases the irritation.

BRIEF SUMMARY OF THE INVENTION

The invention is designed to deflect harmful vapors from reaching the eyes with a high volume of downward forced air produced by an array of light weight battery operated fans located in a visor that is positioned against the forehead above the eyes.

It is specifically designed to pull vapor free air through the attached air supply ducts that are made to extend backwards past the ears behind the user far enough to employ the body as a shield from the vapor causing activities and giving access to the supply of uncontaminated air from behind the user.

The design is light weight and comfortable to wear. It is portable through battery powered operation, adjustable to the users head size, easy to don and remove and allows unobstructed viewing of the food being prepared especially for those wearing eye glasses.

DETAILED DESCRIPTION

Figure 1:
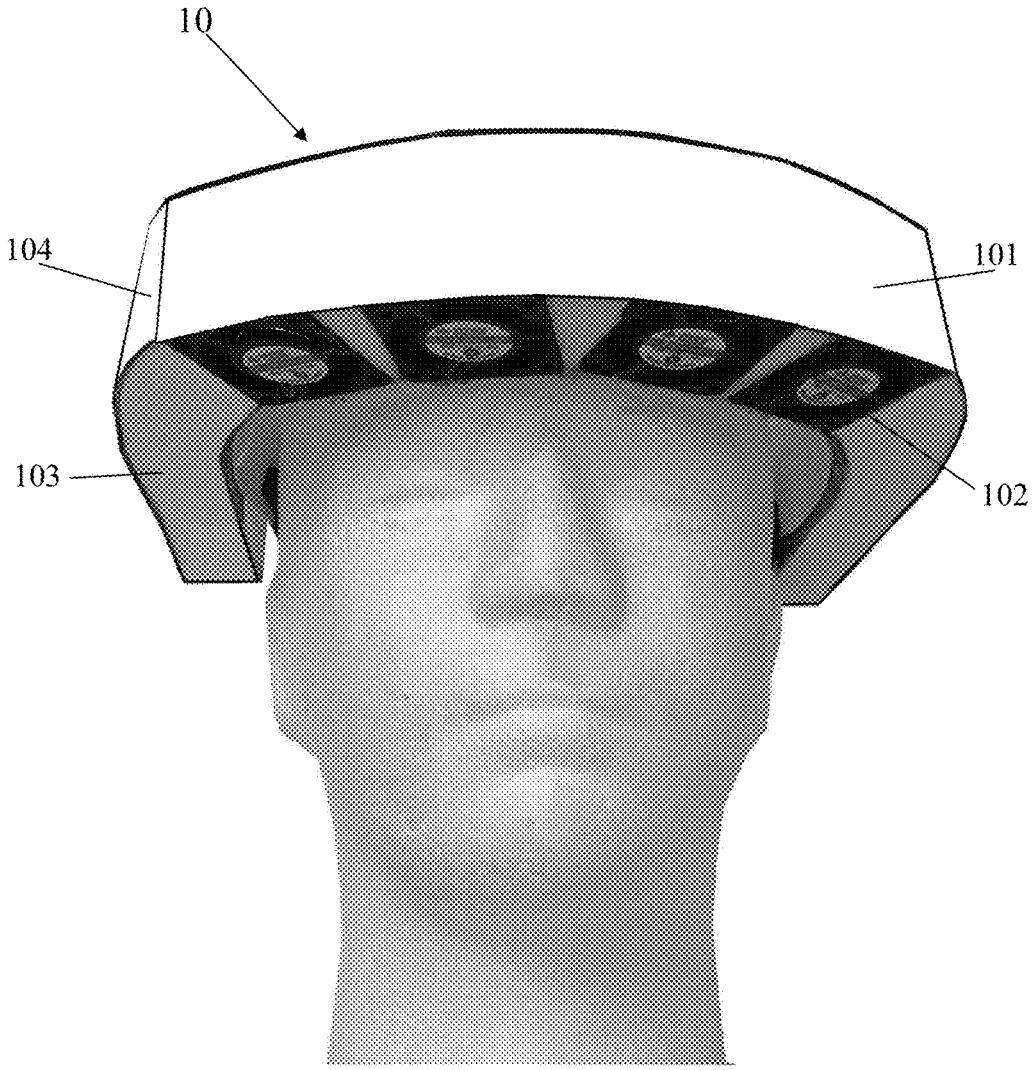
FIG. 1 is a front view of the invention showing the basic design.

As shown in FIG. 1 an embodiment of the invention 10 is a head worn device with a forehead portion identified as the visor chamber 101 with side attached air supply ducts made up of a bottom 103 plate that is duplicated with a top plate and attached to a side plate 104 that is duplicated on the opposite side and extending backward from each side of the visor chamber.

Within the visor, facing downward toward the front of the user, is an array of high velocity battery operated brushless blower fans 102 that extend outward from the forehead to the outer portion of the visor chamber 101. Suitable wiring to interconnect the battery power with the fan motors and switch are within the visor chamber 101 out of sight.

Typically, the components of the device are manufactured utilizing thermoforming and injection molding techniques, however, depending on the geometry or desired structural characteristics, blow-molding and vacuuming forming techniques may alternately be employed. The more lightweight the materials are the better for comfort and ease of use.

Figure 2:
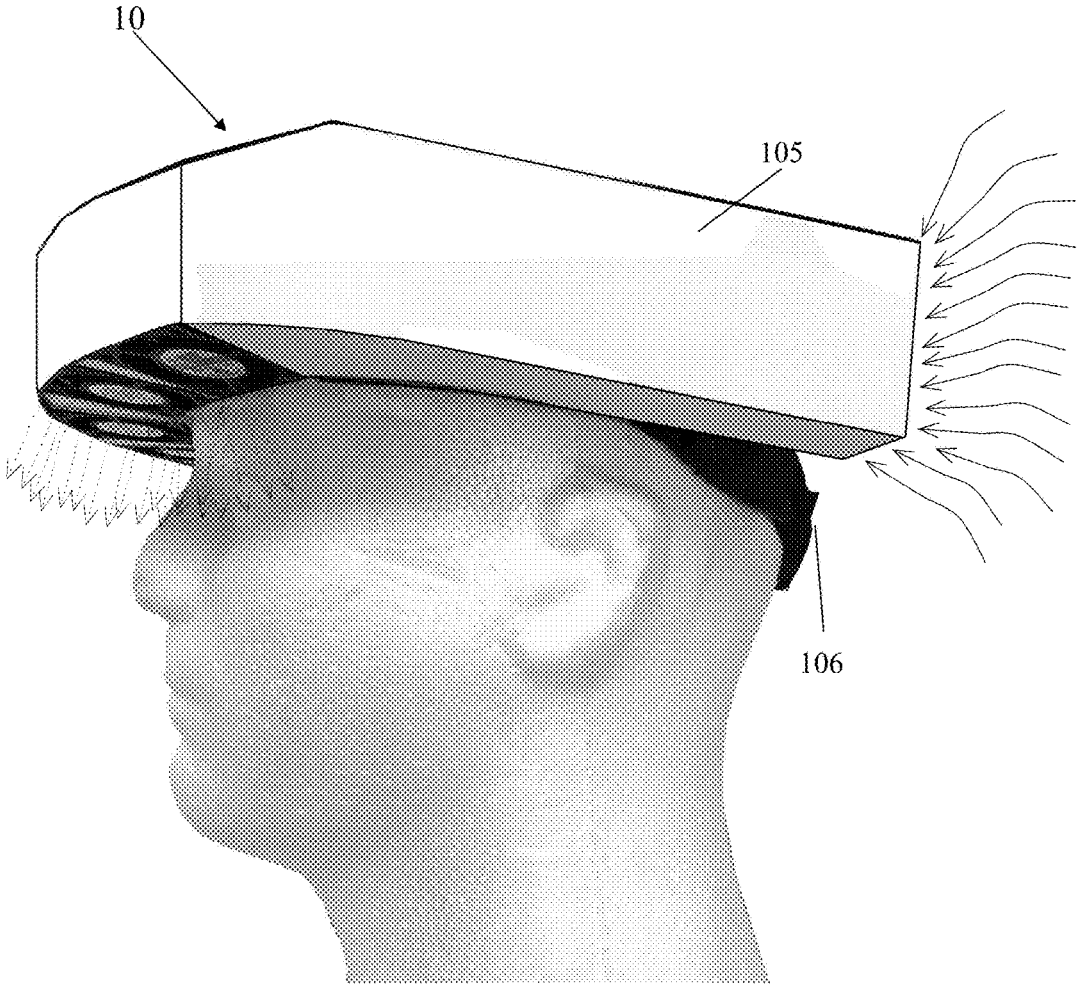
FIG. 2 is a side view with air flow indicators.

FIG. 2 is a side view of the embodiment 10 that displays a head strap 106 for secure attachment to the head using straps with velcro type bonding for adjustment as found on other commonly used head gear that offers adjustment to the users head size and comfort. Other methods can also be used to provide for various head sizes including plastic snap bands found on caps and sports visors as well as a spring type of mechanism to have the side air supply ducts apply a grabbing force around the head that would eliminate the need for the head strap 106.

Also shown in FIG. 2 are air flow indicator arrows that represent the movement of air during operation that is drawn from behind the user into the air supply ducts 105 that is moved through the duct and into the visor chamber where it is expelled by the fans directly in front of the user's eyes, deflecting vapors that rise upward from the food processing activities.

Figure 3:
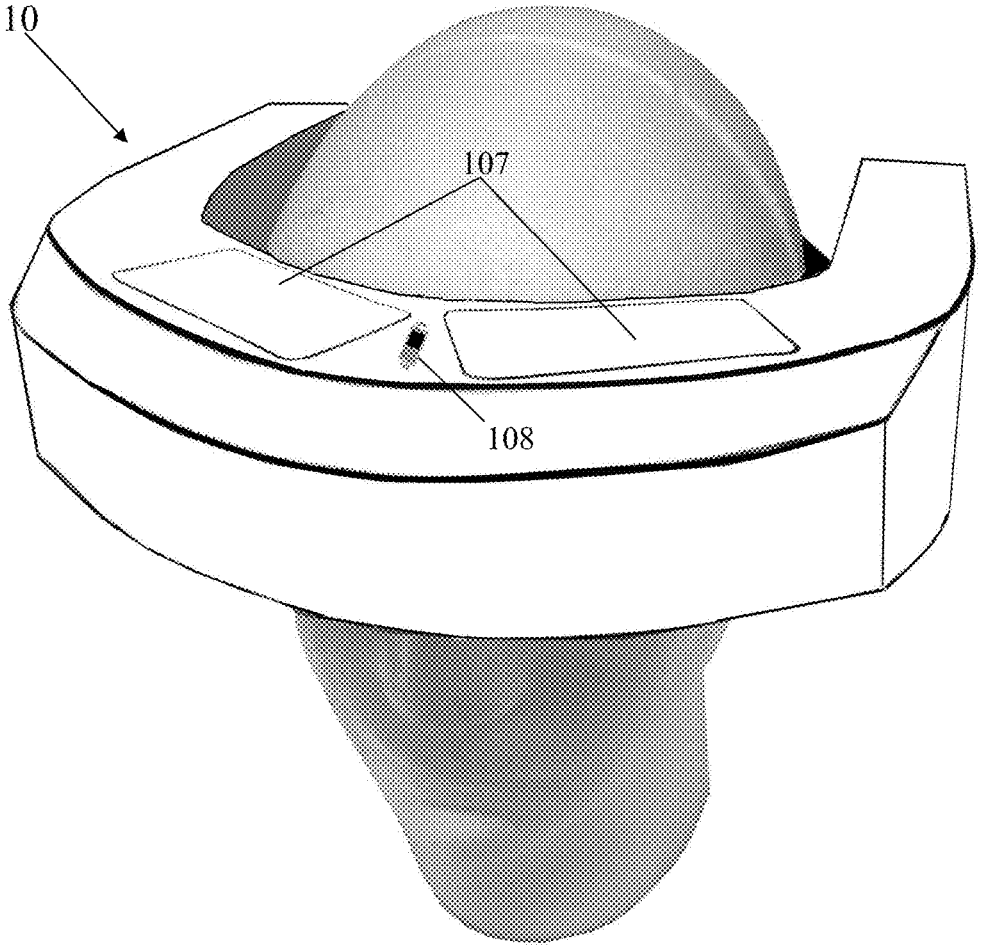
FIG. 3 is a top view that shows features for operation.

FIG. 3 is a top view of embodiment 10 that presents placement of battery access lids 107 and the power on and off switch 108. The view also shows that the visor chamber and the side air supply chambers are combined into the complete device that is a single air distribution system.

Figure 4:
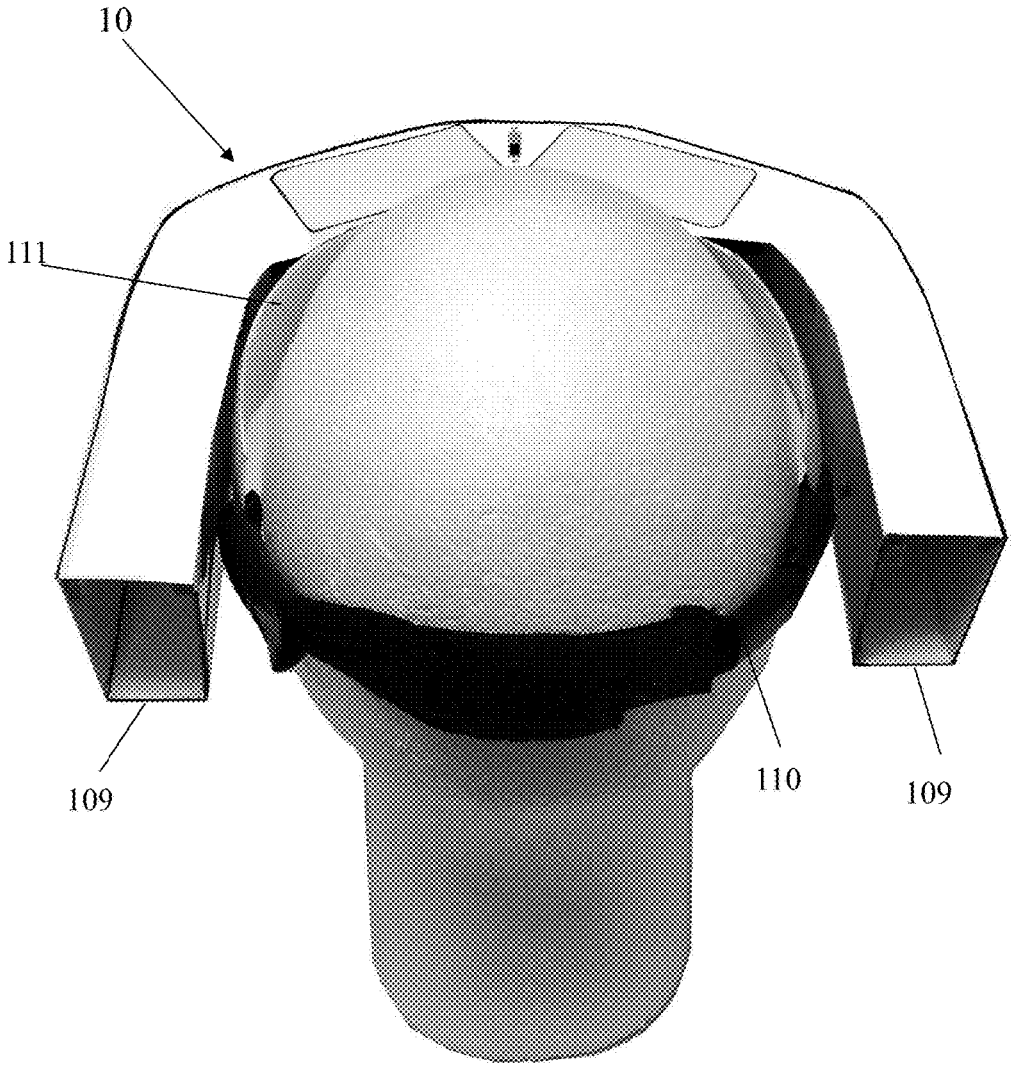
FIG. 4 is a rear view presenting the air inflow duct openings and head band for attachment.

FIG. 4 is a rear view of embodiment 10 showing the air intake openings 109 at the end of the air supply ducts. Also shown is the attaching brow plate 111 that is fixed to the rear of the visor chamber and rests on the brow of the user and shows adjustment straps 110 that are attached to the rear portion. A brow plate is not necessary for proper function and securing the visor to the head. Head straps or plastic snap bands can be attached directly to the rear of the visor chamber using a variety of bonding methods.

Figure 5:
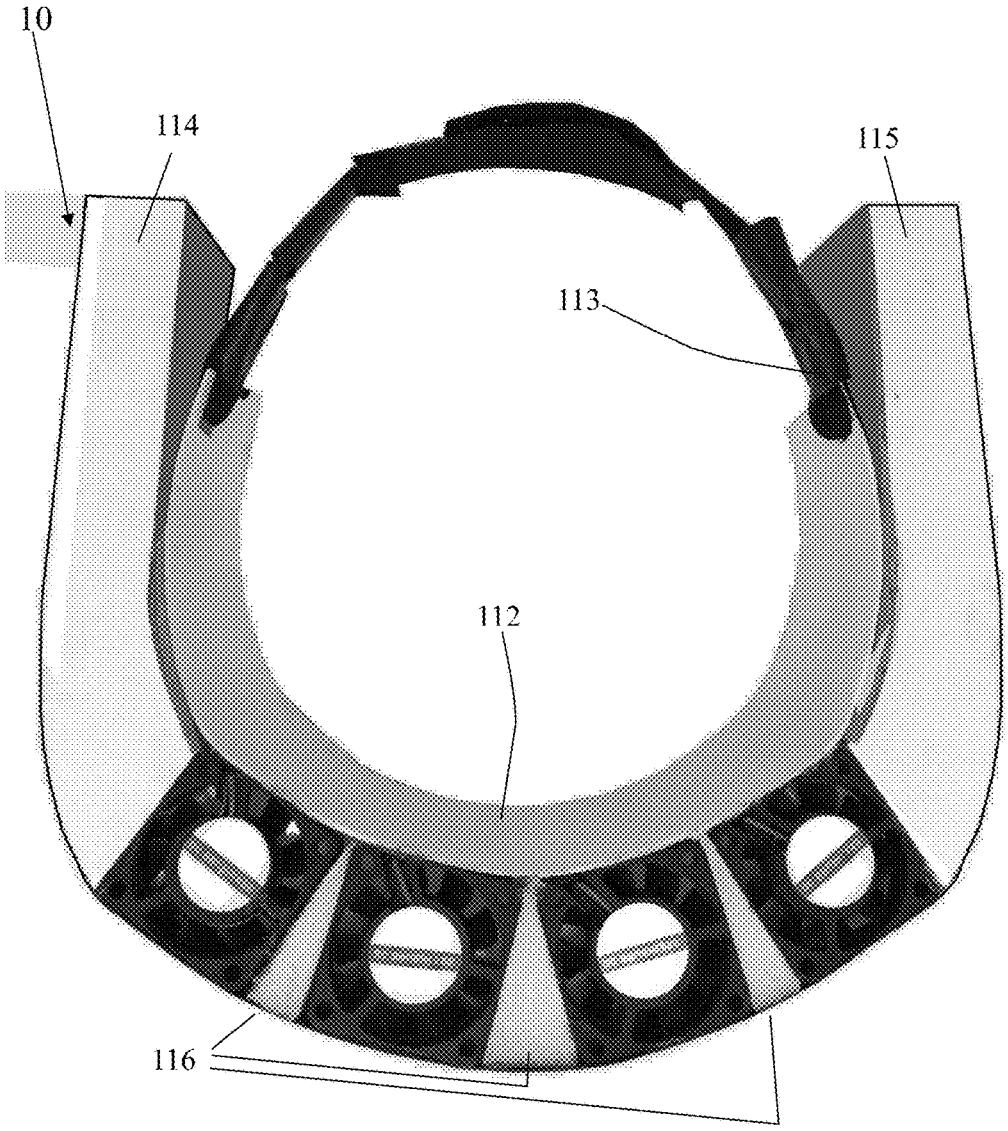
FIG. 5 is a bottom view showing head band attachment and fan space fillers.

FIG. 5 is a bottom view of embodiment 10 showing the brow plate attached to the visor chamber along with the adjustment straps 113. Further display of the closed-air distribution system is also shown with the bottom air supply ducts 114, 115 and fan space fillers 115 used to maintain a sealed chamber and preventing irritating food processing vapors from being drawn into the fans from below the visor.

Figure 6:
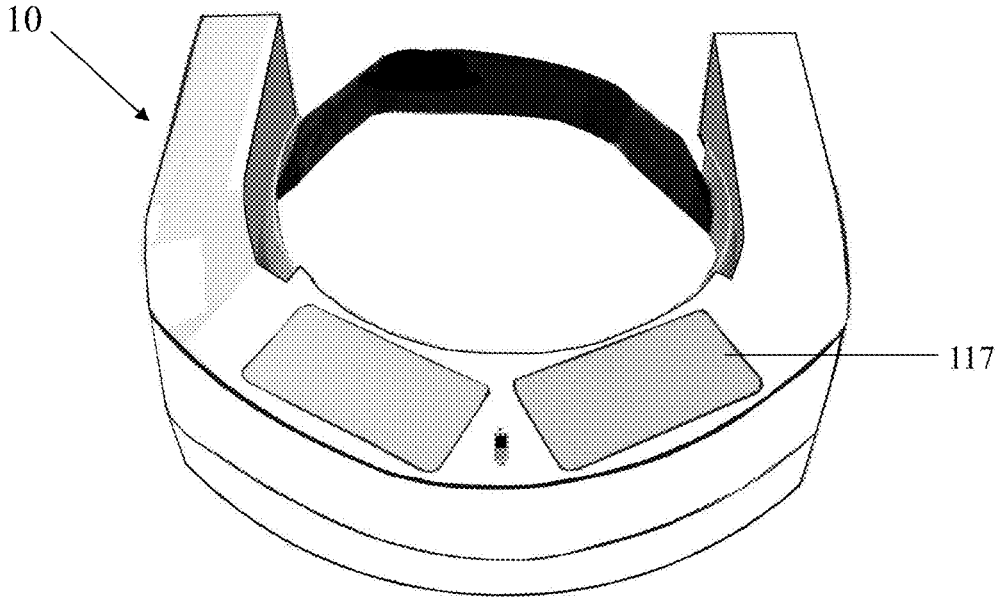
FIG. 6 identifies battery access lids and power switch.
Figure 7:
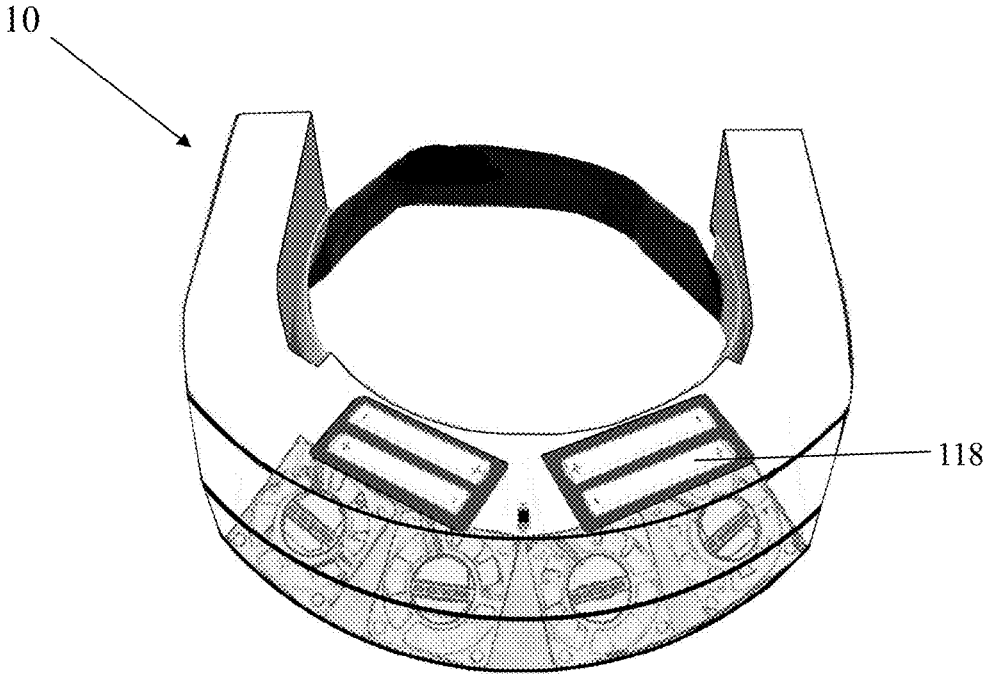
FIG. 7 is an inside view of the battery holder in the visor head chamber.

FIG. 6 and FIG. 7 detail the power supply for embodiment 10 with battery covers 117 of the battery compartments below 118 and show that they are fixed to the upper visor panel leaving air flow space for the fans to receive from the air supply ducts.

The first embodiment 10 shown in FIG. 2 presents the air distribution function of the invention that draws air from behind the user and forces it out the front at eye brow level to deflect vapors that are rising from the foods being prepared that release eye irritants into the immediate air environment in front of the user such as cutting onions or smoke from grilling activities.

Figure 8:
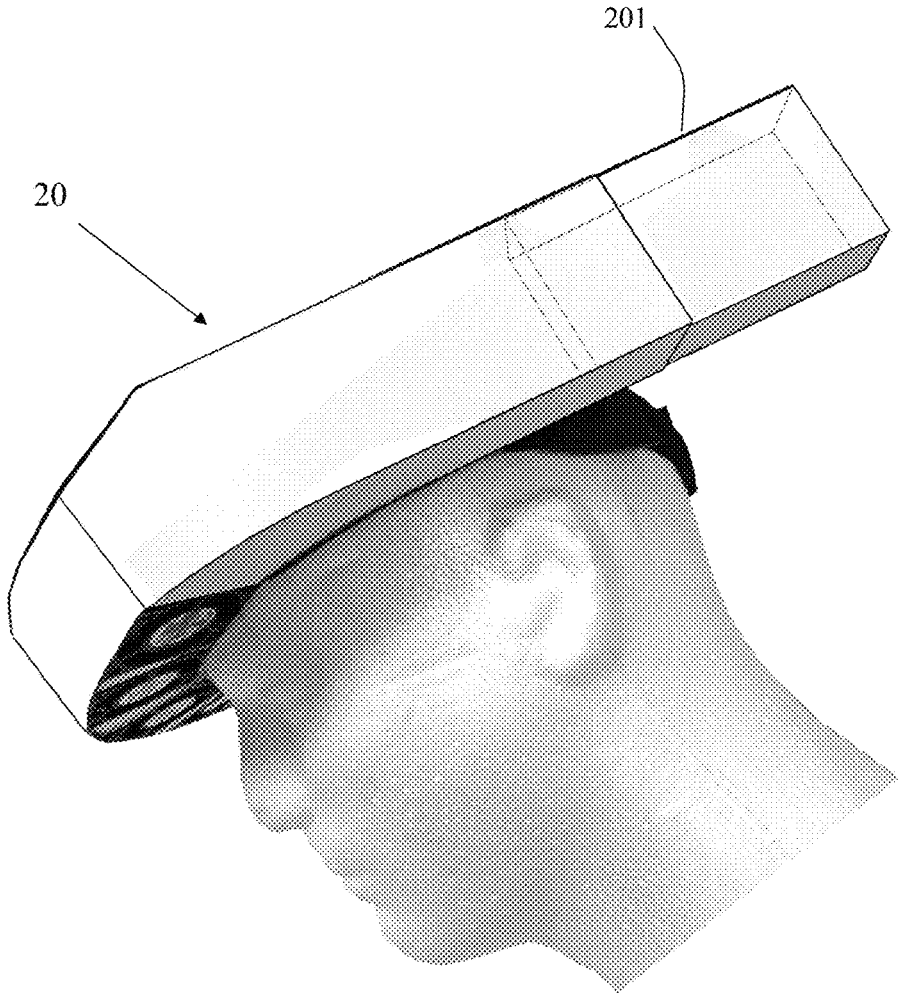
FIG. 8 is a side view of an embodiment with air supply duct extension sleeve.

FIG. 8 shows an embodiment 20 that has a slide-out air supply duct extension 201 to allow for adjustments based on the user's size and height. A person of smaller height will have their eyes closer to the activity producing the vapors and may become enveloped with vapor irritants before the activity is completed and perhaps draw those vapors into the rear chamber openings. The extensions 201 will allow for access to vapor free air from a larger space and height since the intake openings are set away further and raised higher as the user bends their head downward to observe the food preparation activities.

Figure 9:
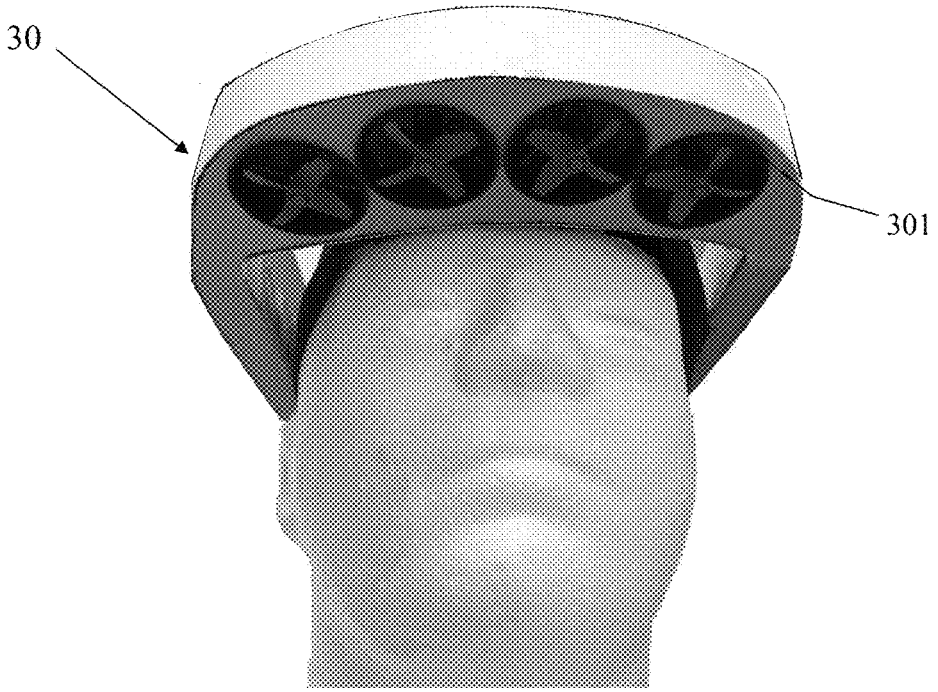
FIG. 9 is an embodiment with an alternate fan type.

High volume, light weight dry cell battery operated fans have become more affordable and available due to the requirements of computer cooling needs and more recently the popularity of hovering devices by hobbyists such as drones. FIG. 9 shows an embodiment 30 that uses a fan array of high speed coreless motors with quad propellers 301 that provide more than enough air flow to deflect even the strongest food vapors. The lower visor chamber plate is made specifically to allow for sealing the round format of the quad propeller array.

Figure 10:
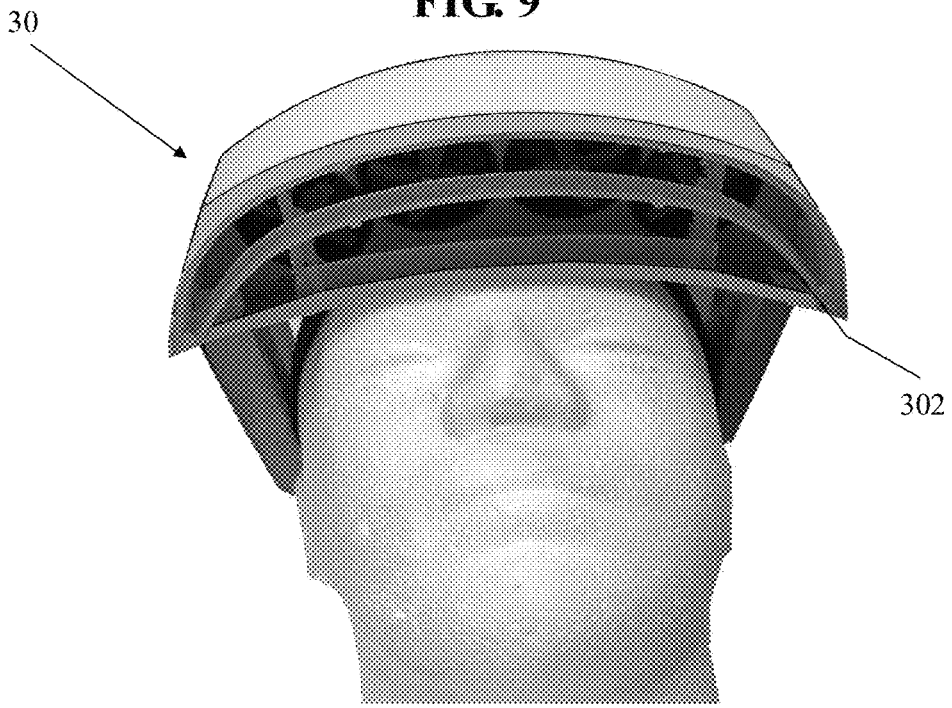
FIG. 10 is a representation of an air guide enhancement on the FIG. 9 embodiment.

FIG. 10 shows embodiment 30 with an accessory to adjust the extremely high air flow more directly where it will provide the best result for an individual user.

Figure 11:
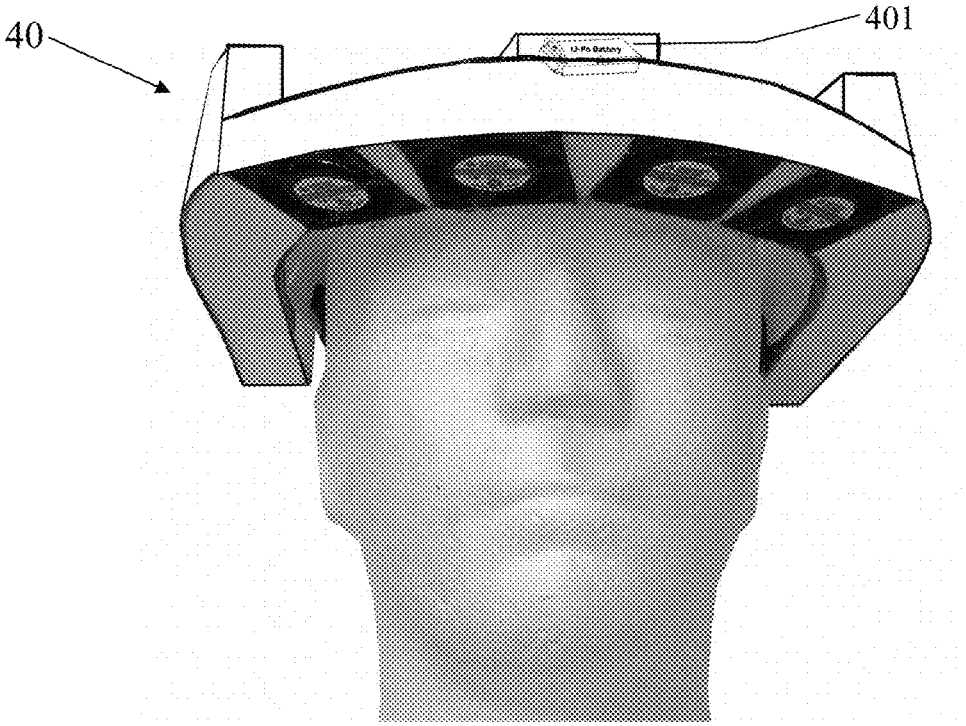
FIG. 11 is a front view of an embodiment using a high powered reduced sized battery producing a slim and lighter visor front.
Figure 12:
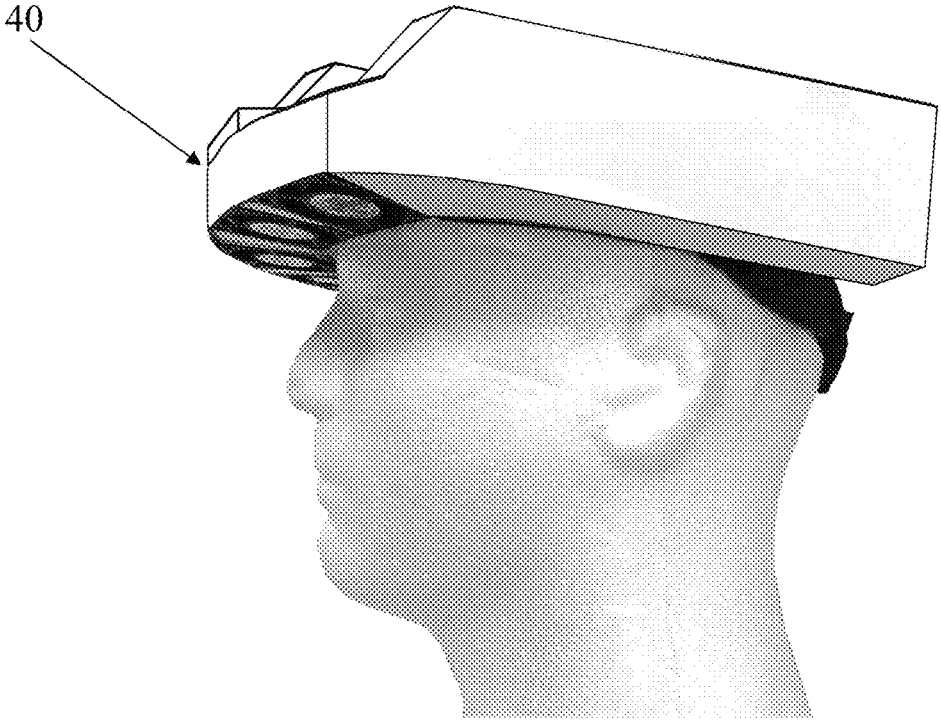
FIG. 12 is a side view of the slim and lighter visor.

FIGS. 11 and 12 show another embodiment 40 that makes use of high powered reduced sized rechargeable Li—Po battery 401 producing a slimmer and lighter visor front. The air supply ducts are sized accordingly to maintain the necessary air volume to produce the required amount of exhaust.

Figure 13:
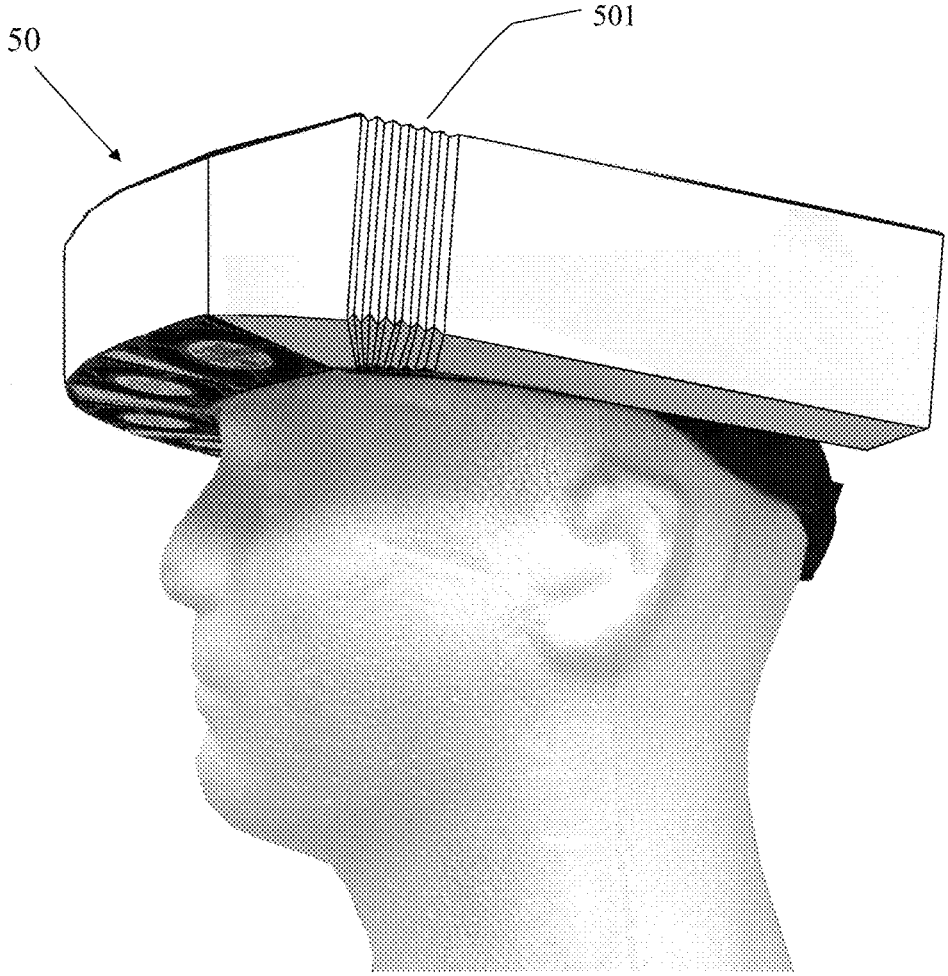
FIG. 13 is a side view of an embodiment with a adjustable air supply ducts.

FIG. 13 shows an embodiment 50 with an adjustable accordion like connector between the side air supply ducts and the visor front chamber that allows for expanding the width between ducts to provide a more contoured fit and larger expansion as may be needed by the user. This also allows for a spring type mechanism to be used on the inside of the device to create a clasping function and eliminate the need for a head strap attachment.

The operation of the invention is accomplished when the user actuates the on/off switch to its on position thereby connecting the motor circuit with the battery circuit to drive the fan motors. The motor of the fan assembly will continue to operate until such time as the on/off switch is moved to its off position or the dry cell battery power dissipates its charge through fan operation.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The presented embodiments are therefore, to be considered as illustrative and not restrictive, the scope of the invention being indicated by the claims rather than the foregoing description, and all changes which come within the meaning and range of the equivalence of the claims are therefore intended to be embraced therein.

The invention claimed is:

1. A visor comprising:

a visor chamber comprising a top plate, a bottom plate, a front plate, and a back plate; wherein the visor chamber is configured to extend across a wearer's forehead above the wearer's eye brow area from temple to temple;

an array of battery powered fans comprising impellers are suspended from the bottom plate of the visor chamber and are positioned in a formation to extend across the visor chamber;

two aft supply ducts contiguous with the visor chamber, each air supply duct having a distal end with an air supply opening, said air supply ducts extending rearward from the visor chamber and configured to extend behind a wearer's head above and beyond the wearer's ears;

fan exhaust openings embedded in the bottom plate of said visor chamber;

wherein said visor chamber also includes dry cell battery mounting compartments and electronic connections to said array of fans, in addition to a power control on/off switch, the battery mounting compartments are accessed from lids attached to the top plate of said visor chamber for replacement and repair;

adjustable straps attached to the back plate of the visor chamber either directly or by a brow plate attachment and configured to hold the visor in position on the wearer's forehead;

wherein said aft supply ducts are configured to draw air from behind the wearer into the visor chamber via the array of fans pulling air into said impellers and expelling aft through the fan exhaust openings as a deflecting force of air or an air curtain, downward in front of the wearer's eyes.

* * * * *